United States Patent [19]

Patton et al.

[11] 4,138,683

[45] Feb. 6, 1979

[54] SHORT RADIATING HORN WITH AN S-SHAPED RADIATING ELEMENT

[75] Inventors: Willard T. Patton, Moorestown; Norman R. Landry, Willingboro, both of N.J.

[73] Assignee: RCA Corporation, New York, N.Y.

[21] Appl. No.: 817,687

[22] Filed: Jul. 21, 1977

[51] Int. Cl.[2] ..... H01Q 3/26

[52] U.S. Cl. ..... 343/783; 343/772

[58] Field of Search ..... 343/786, 783, 772–774

[56] References Cited

U.S. PATENT DOCUMENTS

| | | | |
|---|---|---|---|
| 3,534,376 | 10/1970 | Webb | 343/786 |
| 3,778,717 | 12/1973 | Okoshi et al. | 343/772 |

*Primary Examiner*—Alfred E. Smith
*Assistant Examiner*—David K. Moore
*Attorney, Agent, or Firm*—H. Christoffersen; Joseph D. Lazar

[57] ABSTRACT

The rear wall of a horn antenna is a substrate with a phase shifter circuit thereon. Power from the phase shifter is radiated by the horn via a probe that has the general shape of a hook.

3 Claims, 3 Drawing Figures

SHORT RADIATING HORN WITH AN S-SHAPED RADIATING ELEMENT

BACKGROUND OF THE INVENTION

1. Field of the Invention

This invention relates to radar and more particularly to phased array radar.

2. Description of the Prior Art

An antenna in one type of a phased array radar is comprised of 4480 radiating horns. Each of the horns provides a three thousand watt pulse of radiation that comprises a component of a radar beam. In the horn, the radiation is in a $TE_{10}$ mode. Outside of the horn, the radiation is in a TEM mode.

The beam has a direction that is usually expressed as a pointing angle subtended from a central axis of the antenna. The pointing angle is determined by the respective phase angles of excitation of the horns. The excitation with desired phase angles is provided to the horns via phase shifters. Since the antenna is comprised of 4480 horns the radar includes 4480 phase shifters.

An undesired coupling of signals from the phase shifters is obviated by enclosing each of the phase shifters in a metal enclosure. Accordingly, the phase shifters and horns comprise 4480 subassemblies where each of the enclosures has a proximal surface that abuts the closed end of the horn.

Electromagnetic energy propogates in a subassembly along a path from a phase shifter to a horn through an interface therebetween. The interface is a discontinuity in the path. Because of the discontinuity, the horn may be excited in modes of orders that are higher than the $TE_{10}$ mode. The excitation in the higher order modes affects the radar beam in an unpredictable manner.

The horn is on the order of twenty centimeters from its closed end to its open end. The twenty centimeter length is needed to provide a region in the horn where there is a decay of the energy in the higher order modes. Moreover, the twenty centimeter length provides for space near the open end of the horn where a pair of capacitive coupling irises and an inductive coupling iris are disposed to provide an impedance match between the horn and free space.

The subassembly typically has a length of thirty two centimeters from the distal non-abutting surface of the enclosure of the phase shifter to the open end of the horn. Since there are 4480 phase shifters and 4480 horns, the phased array radar is bulky and heavy.

The discontinuity is eliminated from the subassembly when the horn and the phase shifter are of an integrated construction. An integrated subassembly has not been constructed because of a belief that an undesired coupling between the horn and the phase shifter is inherent in the integrated subassembly.

SUMMARY OF THE INVENTION

According to the present invention, the exterior of a horn antenna has the general shape of a rectangular parallelepiped that is open on one side. The interior of the horn includes an integrated phase shift circuit disposed upon a substrate that forms a wall of the horn opposite from the open side. A probe comprised of a wire in the general shape of a hook has a section that is connected to the substrate and a section parallel to the substrate. Excitation applied to the phase shifter causes the probe to establish within the horn an electric field with lines of force parallel to the substrate, thereby establishing a TEM mode of propagation of electromagnetic energy from the open side.

DESCRIPTION OF THE PREFERRED EMBODIMENT

The preferred embodiment is a horn of a phased array radar antenna that operates in what is known as the S-band (3.1 GHz to 3.5 GHz). However, it should be understood that the invention is applicable to frequency ranges other than the S-band.

Figure 1:
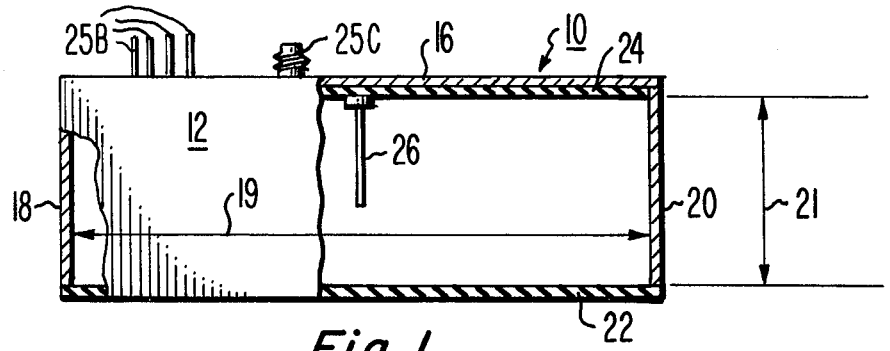
FIG. 1 is a plan view, with parts broken away, of a preferred embodiment of the present invention.
Figure 2:
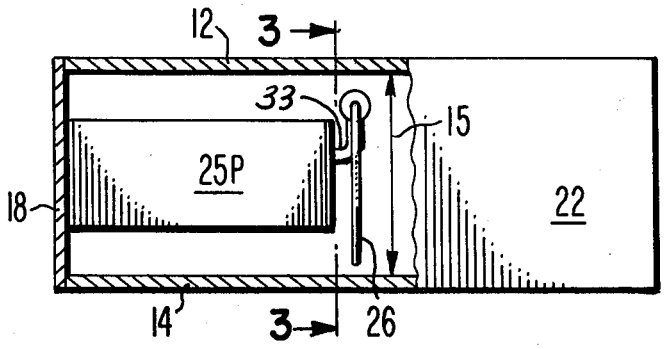
FIG. 2 is a front view, with parts broken away, of the embodiment of FIG. 1.

As shown in FIGS. 1 and 2, a horn 10 of a phased array radar antenna has a metal top wall 12 and a metal bottom wall 14 that are separated by a distance 15 which approximately equals 1.969 centimeters. Walls 12 and 14 are connected to a metal rear wall 16 and side walls 18 and 20 to form a rectangular parallelepiped with an open side. In this embodiment, walls 18 and 20 are separated by a distance 19 that approximately equals 7.049 centimeters. Wall 16 and the open side are separated by a distance 21 that approximately equal, 1.918 centimeters.

Preferably, the open side is covered by an alumina wall 22 which is approximately 0.64 millimeters thick. Wall 22 is fixedly connected to top wall 12, bottom wall 14 and side walls 18 and 20. Wall 22 protects the interior of horn 10 from rain and snow and dissipates heat when horn 10 radiates a component of a radar beam and, accordingly, may alternatively be formed of a suitable plastic or ceramic insulation other than alumina.

Within horn 10 is an alumina substrate 24 which is approximately 1.27 millimeters thick. Substrate 24 is connected in an abutting relationship with substantially all of wall 16.

An integrated phase shifter 25P of any suitable type is disposed upon substrate 24. Excitation at a frequency in the S band is provided to phase shifter 25P via a connector 25C that is mounted on wall 16 and has a center conductor (not shown) that extends through holes (not shown) in wall 16 and substrate 24.

Preferably, phase shifter 25P comprised of a plurality of branch line couplers that are loaded by PIN diodes. The PIN diodes are selectively biased to cause phase shifter 25P to provide a current with a selected phase shift at the S band frequency. Bias signals are provided via a plurality of signal lines 25B that extend from phase shifter 25P to the exterior of phase shifter 10 through wall 16 and substrate 24.

Preferably, phase shifter 25P is coated with a room temperature vulcanizing silicone rubber, such as that marketed by Dow-Corning Corporation under the trademark, Sylgard. The coating provides electrical insulation of components of phase shifter 25P. When phase shifter 25P is coated, it has a 5000 watt power handling capability.

As known to those skilled in the art, alumina has a permittivity greater than the permittivity of air. Therefore, electromagnetic energy that propagates in phase shifter 25P is concentrated within substrate 24. The electromagnetic energy with the desired phase shift exits from substrate 24 via a probe 26 that has a disposition and dimensions which have been determined by trial and error.

Figure 3:
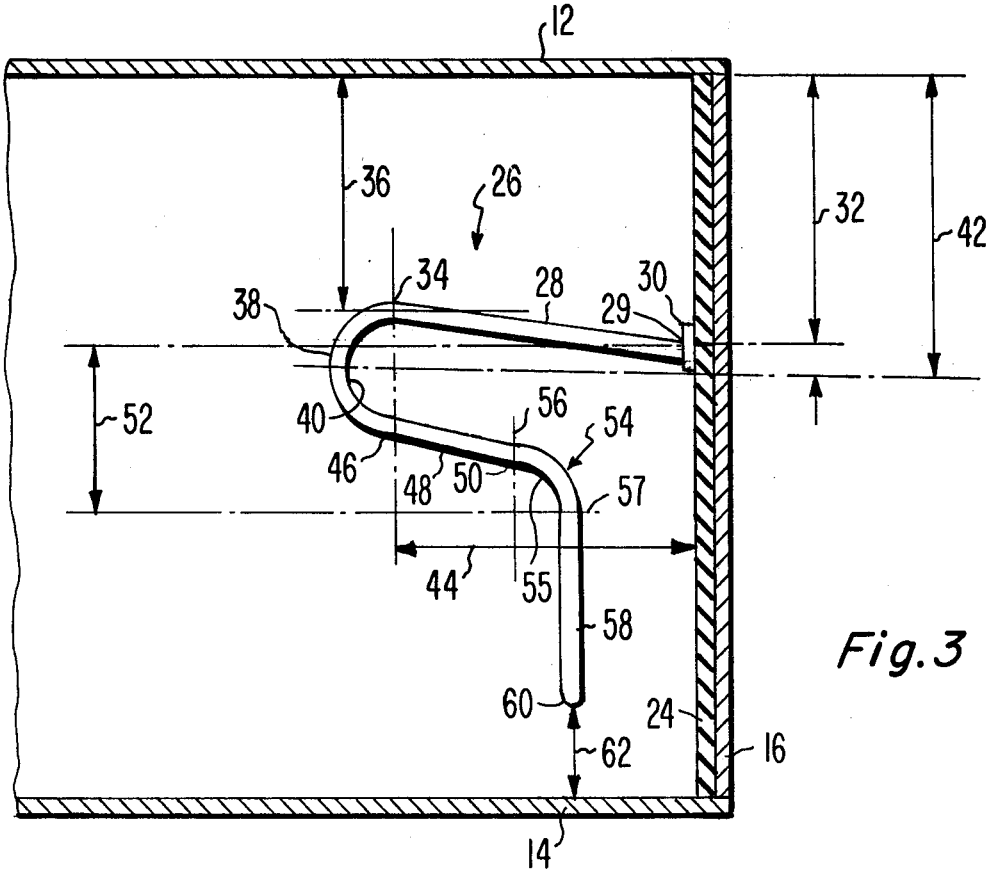
FIG. 3 is a fragmentary view of the embodiment of FIG. 1 taken along the line 3—3 of FIG. 2.

As shown in FIG. 3, probe 26 is constructed from a cylindrical brass rod with a length of approximately 3.08 centimeters and a diameter of approximately .965 millimeters. Probe 26 is bent to form the general shape of a hook with a shank that is parallel to substrate 24. The dimensions of probe 26 are stated hereinafter.

As shown in FIG. 3, probe 26 has a straight exit section 28 with an end 29 connected to the center of a top surface of a gold plated disc shaped brass pad 39 which is described hereinafter. The axis of pad 30 is midway between walls 18 and 20 at a distance 32 from wall 12 which is approximately 0.208 centimeters. Moreover, probe 26 is disposed substantially within a plane midway between walls 18 and 20.

Pad 30 is connected to phase shifter 25P by a conductor 33 disposed upon substrate 22. Phase shifter 25P provides the current at the S band frequency with the desired phase shift to probe 26, whereby the electromagnetic energy with the desired phase shift exits from substrate 24 via section 28 and pad 30. Since probe 26 extends into air, probe 26 radiates the electromagnetic energy.

Section 28 has an end 34 where the center of section 28 is a distance 36 from wall 12. Distance 36 is approximately 0.170 centimeters. End 34 is integral with an arcuate section 38 that defines an interior line 40. Line 40 has a center of curvature at a distance 42 from wall 12 and a distance 44 from substrate 24. Distances 42 and 44 are approximately 0.343 centimeters and 1.011 centimeters, respectively. The radius of curvature of line 40 is approximately 0.125 centimeters.

Arcuate secton 38 has an end 46 that is integral with a straight section 48 that has an end 50. At end 50, section 48 is integral with an arcuate section 54 that defines an interior line 55. Line 55 has a center of curvature at a distance 52 from the axis of pad 30. Distance 52 is approximately 0.594 centimeters. Additionally, the center of curvature of line 55 is along a line 56 that passes through end 50 and is perpendicular to walls 12 and 14.

Section 50 has an end 57 that is integral with a straight shank section 58 that is parallel to substrate 24 and has an end 60 that is rounded to have the shape of a hemisphere. Additionally, end 60 is at a distance 62 from wall 14. Distance 62 is approximately 0.277 centimeters.

Because section 58 is parallel to substrate 24, excitation applied to phase shifter 25P causes probe 26 to establish a TEM mode of propagation of electromagnetic energy through wall 22. Moreover, substantially all energy provided to probe 26 from phase shifter 26P propagates through wall 22. It should be appreciated that phase shifter 25P and probe 26 have a VSWR of less than 1.5.

Pad 30, referred to hereinbefore, has a diameter and a thickness of approximately 0.229 centimeters and 0.254 millimeters, respectively.

Since horn 10 has phase shifter 25P disposed on substrate 24, horn 10 and phase shifter 25P are of an integrated construction with no discontinuity therebetween. Because of the integrated construction, a need for coupling irises is obviated whereby distance 21 is typically less than seven percent (i.e., a reduction of 93 percent) of a corresponding distance in a construction where a horn and a phase shifter are not integrated.

What is claimed is:

1. A radiating element of a phased array radar, comprising:

a substantially rectangular alumina substrate;

four metal rectangular walls connected to said substrate to define a parallelepiped with an open side opposite from said substrate;

an integrated phase shifter that provides current in response to an excitation signal and is operable to cause said current to have a selected phase in response to a selection signal, said phase shifter being disposed upon said substrate within said parallelepiped; and a metal wire probe connected to said phase shifter on said substrate and extending therefrom to the interior of said parallelepiped, said probe having the general shape of a hook with a shank that is parallel to said substrate.

2. The radiating element of claim 1 additionally comprising an alumina wall that covers said open side.

3. The radiating element of claim 1 wherein said probe is substantially within a plane between two of said metal walls that are opposed to each other.

* * * * *